United States Patent [19]

Tame

[11] Patent Number: 4,589,212

[45] Date of Patent: May 20, 1986

[54] METHOD AND APPARATUS FOR FASTENER PLACEMENT ON GARMENTS

[76] Inventor: Afif Tame, 20805 Victor St., Torrance, Calif. 90503

[21] Appl. No.: 722,851

[22] Filed: Apr. 12, 1985

[51] Int. Cl.[4] ..... A41H 25/00

[52] U.S. Cl. ..... 33/190

[58] Field of Search ..... 33/190, 189, 18 R, 192

[56] References Cited

U.S. PATENT DOCUMENTS

| | | | |
|---|---|---|---|
| 455,759 | 7/1891 | McCoy | 33/190 |
| 1,057,456 | 4/1913 | Rogers | 33/190 |
| 1,624,622 | 4/1927 | Pectal et al. | 33/190 |
| 2,111,612 | 3/1938 | Brostrom | 33/189 |
| 2,448,627 | 9/1948 | Schaffner | 33/189 |
| 2,613,446 | 10/1952 | Heimlich | 33/190 |
| 2,925,661 | 2/1960 | Bagley | 33/190 |
| 3,331,135 | 7/1967 | Urish | 33/190 |
| 3,442,022 | 5/1969 | Maier | 33/190 |

*Primary Examiner*—Willis Little

*Attorney, Agent, or Firm*—Charles H. Thomas

[57] ABSTRACT

A method and apparatus are provided for effectuating the proper placement of the male and female portions of releasable fasteners, such as buttons and buttonholes, on the lapping edges of garments. First and second markers are longitudinally aligned and biased apart. The edges of fabric material which are to receive the respective fastener portions are juxtaposed in the alignment which they are to have in the finished garment. The first and second markers are drawn together to pinch the fabric therebetween, thereby simultaneously marking the juxtaposed fabric edges with the locations at which the fastener portions are to be placed. The fabric edges are then transversely advanced until the most recently marked location arrives at an indicator located a predetermined distance from the markers, and the process is repeated.

7 Claims, 4 Drawing Figures

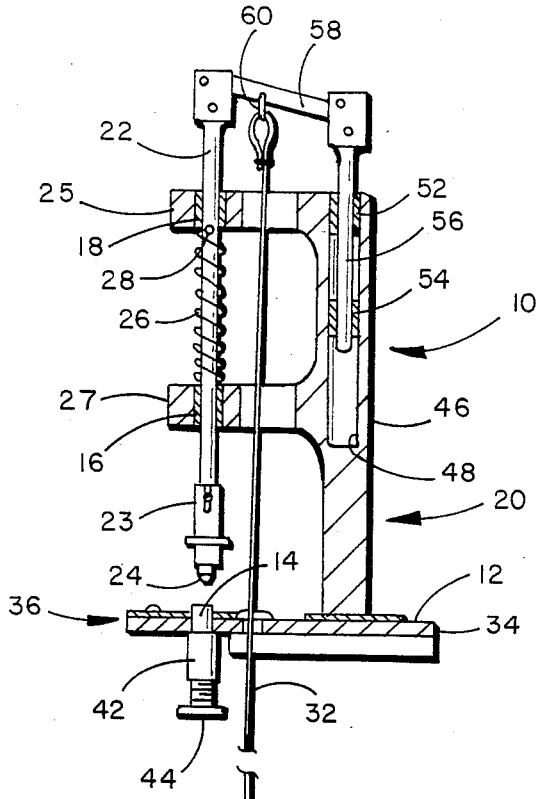
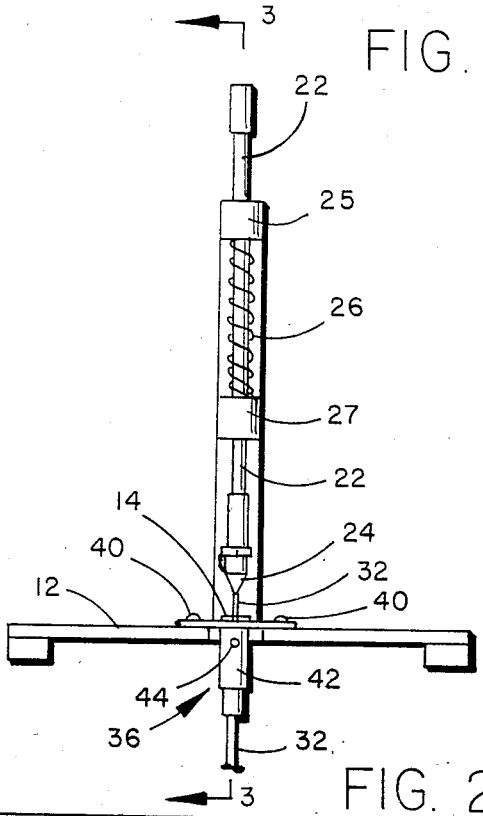
FIG. 1
FIG. 2
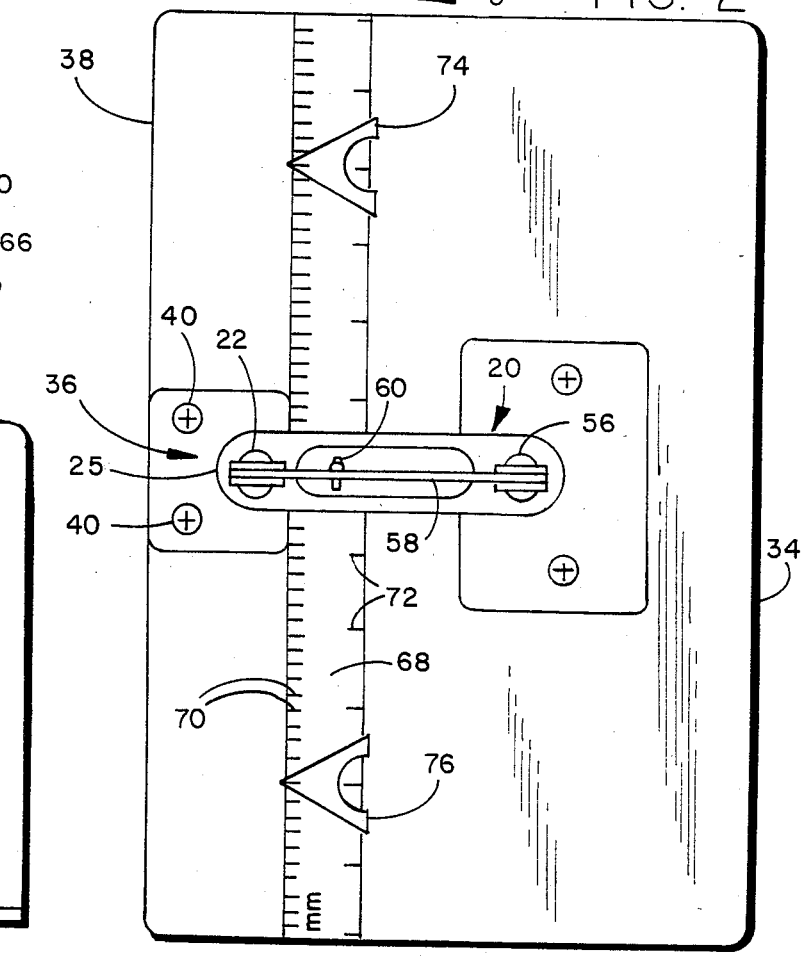
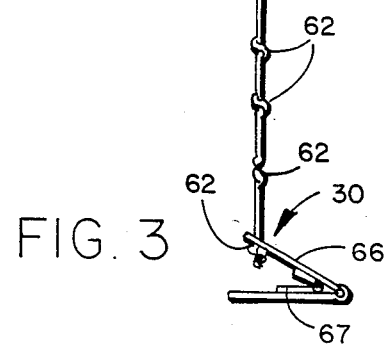
FIG. 3
FIG. 4
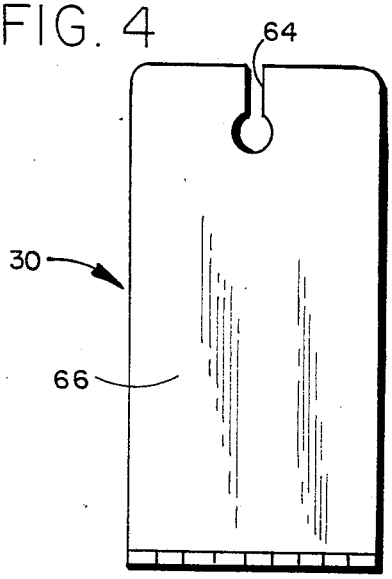

METHOD AND APPARATUS FOR FASTENER PLACEMENT ON GARMENTS

BACKGROUND OF THE INVENTION

1. Field of the Invention

The present invention relates to a method and apparatus for accurately locating the positions of releasable fasteners on garments.

2. Description of the Prior Art

The present technique currently employed in the manufacture of garments for the placement of buttons thereon is excessively laborious and time consuming. According to conventional practice, a template is employed for each size of garment manufactured in order to mark the locations of releasable fasteners, such as buttons, on overlapping edges of material of the garment. For example, in a shirt or blouse which buttons down the front, the overlapping edges of material respectively bear buttons and buttonholes. To mark the placement of the buttons and buttonholes on the overlapping edges, the template for the particular size garment involved is first positioned along one of the edges of the fabric which is to bear the buttons or buttonholes. The template is moved to the tail edge of the shirt or blouse, and a graphite pencil is employed to mark the locations of all of the buttons or buttonholes on the surface of the fabric through apertures in the template. Once all of the buttons or buttonholes are marked along one edge of the garment, the template is moved to the opposing garment edge, and the corresponding, mating portions of the fasteners are likewise marked with the graphite pencil through the template apertures.

This prior technique of marking the locations of buttons and buttonholes to be sewn on a garment is excessively time consuming. Moreover, the template is all too often mispositioned or slips during the marking process. When this occurs the corresponding buttons and buttonholes are misaligned and the garment is useless unless reworked.

SUMMARY OF THE INVENTION

The present invention provides a method and a machine for accurately and quickly marking the locations of corresponding fastener portions on garment edges. According to the invention, the corresponding buttons and buttonholes are marked simultaneously on the respective edges of the garments upon which they are to be placed. As a result, the opportunity for misalignment of corresponding buttons and buttonholes is sharply reduced. Furthermore, the time required to effectuate marking the button and buttonhole locations for placement is also greatly reduced. Using the method and the machine of the invention work that previously took three to four people five or six hours to perform is now performed by one person in about an hour, using the machine of the invention.

In one broad aspect the invention may be considered to be an apparatus for marking mating male and female fastener locations on garments. The apparatus employs a flat platform and a first marking means, such as a graphite pencil, located at the flat platform. A mounting support carries a guide means in spatial separation from the platform so that the guide is spaced from the platform in longitudinal alignment with the first marking means. A rod is reciprocally mounted in the guide and a second marking means, such as another graphite pencil, is carried by the rod and directed toward the first marker. A biasing means, such as a spring, is disposed to urge the rod away from the platform. An actuating means is employed for overcoming the biasing means to draw the second marker toward the first marker. Preferably, the platform is provided with measuring indicia. As juxtaposed edges of material are currently marked with button and buttonhole locations, the fabric material is drawn transversely across the platform until the most recently placed markings arrive at the indicia. This provides the proper spacing between the successive buttons along one edge of the fabric and the successive buttonholes along the opposing edge.

In another broad aspect the invention may be considered to be a method for marking the locations of interengageable, mating male and female fastener portions on clothing. The method involves juxtaposing the edges of clothing material which are to bear the corresponding male and female portions of the fasteners. The juxtaposed edges are then pinched from opposite sides with longitudinally aligned first and second markers to simultaneously mark the juxtaposed fabric edges on the opposite, exposed surfaces thereof. The juxtaposed edges are then transversely advanced a predetermined distance. The steps of pinching the juxtaposed fabric edges between the markers and transversely advancing the juxtaposed fabric edges is repeated until all the fastener locations on the juxtaposed edges of material have been marked.

DESCRIPTION OF THE DRAWINGS

FIG. 1 is a front elevational view of a machine according to the invention for performing the method of manufacture according to the invention.

FIG. 2 is a top plan view of the machine of FIG. 1.

FIG. 3 is a side sectional elevational view of the machine of FIG. 1 taken along the lines 3—3 thereof.

FIG. 4 is a top plan view of the foot treadle illustrated in FIG. 3.

DESCRIPTION OF THE EMBODIMENT AND IMPLEMENTATION OF THE METHOD

A machine 10 forms an apparatus for marking mating male and female fastener locations on garments. The machine 10 employs a flat, planar platform 12, preferably formed of steel approximately 1 foot long and 8 inches deep. A graphite pencil 14, flattened on the top, is vertically oriented in an aperture defined through the platform 12. Cylindrical, annular bronze guiding bushings 16 and 18 are vertically spaced from the platform 12 in longitudinal alignment with the first marking pencil 14. The annular bushings 16 and 18 are carried by arms 25 and 27 from an F-shaped aluminum mounting frame 20 which is secured on the top of the platform 12. The mounting frame 20 holds the guide bushings 16 and 18 in vertical, longitudinal alignment with each other and with the first graphite pencil 14. A cylindrical steel rod 22 is reciprocally mounted in the guide bushings 16 and 18 and carries a second graphite pencil 24 which is directed toward the first graphite pencil 14 and which is mounted in a cylindrical, annular sleeve 23 at the lower end of the rod 22. A biasing, coil spring 26 is disposed coaxially about the rod 22 and is interposed to bear downwardly against the lower arm 27 of the mounting frame 20 and upwardly against a transverse bearing pin 28 that passes through the rod 22. The spring 26 thereby urges the rod 22 upwardly away from the platform 12.

An actuating mechanism, which in the embodiment depicted is a foot treadle 30, is provided to overcome the bias of the spring 26. The foot treadle 30 acts upon the rod 22 through a flexible nylon line 32 to draw the second marking pencil 24 toward the first marking pencil 14.

The platform 12 may be mounted upon a stand, but more typically is designed to be secured by clamps at its rear edge 34 to a table or other available support structure a comfortable distance above the floor. The first graphite pencil 14 has a flattened top and is secured to the platform 12 in a mounting subassembly 36. The subassembly 36 slides laterally into a channel-shaped recess in the front edge 38 of the platform 12 and is secured to the platform 12 by means of screws 40. On the underside of the subassembly 36 there is a vertically oriented, cylindrical annular, interiorally threaded collar 42 having an axially aligned adjustment screw 44 threadably engaged therein. The vertical position of the first graphite marker 14 can be adjusted by rotating the adjustment screw 44, which in turn carries the first marker 14 to a selected elevation relative to the platform 12. The upper extremity of the marker 14 should protrude just above the surface of the platform 12 so as to be able to contact and mark fabric on the platform 12, but should not be so high as to interfere with transverse movement of the fabric across the platform 12.

The F-shaped mounting frame 20 includes an upstanding post 46 rising upwardly from the rear of the platform 12. Upper and lower arms 25 and 27, respectively, extend forwardly from the post 46. The arms 25 and 27 have vertically aligned cylindrical openings defined therein to receive the bronze bushings 18 and 16, respectively. The bushings and 16 and 18 are secured by friction within the vertically aligned openings in the arms 25 and 27 and define a vertical path of reciprocal movement for the rod 22.

A bore 48 extends vertically downward from the top of the upstanding post 46 into the interior thereof. A pair of cylindrical annular bronze bearings 52 and 54 are disposed in the bore 48. The bore 48 and the bearings 52 and 54 define a longitudinal track which is parallel to the rod 22. An elongated, cylindrical stabilizing slidebar 56 is reciprocally mounted to move along the track parallel to the rod 22. The upper extremities of both the rod 22 and the slide 56 terminate in clevices which receive the ends of a connecting crossbeam 58 extending therebetween. The ends of the crossbeam 58 are thereby hingedly joined to both the rod 22 and the stabilizing slide 56.

A control line eye 60 is located on the underside of the crossbeam 58. The upper extremity of the control line 32 is looped through the eye 60. The lower extremity of the control line 32 includes a series of knots 62 at vertically spaced intervals. The control liine 32 passes through a slot 64 in the moveable pedal 66 of the foot treadle 30. The slot 64 is of sufficient width to allow passage of the control line 32, but the knots 62 will not pass through the slot 64. The control line 32 is inserted into the slot 64 with the foot treadle 30 on the floor so that no tension is exerted on the control line 32 when the pedal 66 of the foot treadle 30 is released, but also so that the depressible pedal 66 of the foot pedal 64 will exert downward tension on the contol line 32 when the pedal 66 of the treadle 30 is depressed. When depressed the underside of the pedal 66 bears against the closest knot 62 immediately therebelow. The knot 62 will not pass through the slot 64 so that as the foot pedal 66 is depressed, tension is exerted on the control line 32 and the crossbeam 58 is pulled downward. The downward movement of the crossbeam 58 forces both the rod 22 and the slide 56 vertically downwardly as well. The downward movement of the rod 22 draws the second graphite marker 24 toward the first graphite marker 14. Juxtaposed edges of fabric to be marked are pinched between the markers 14 and 24 to simultaneously mark the locations of a buttonhole on one fabric edge and a corresponding button on the other corresponding fabric edge.

A scale or ruler 68 has indicia thereon located at uniform, spaced intervals. The scale 68 is mounted upon the upper surface of the platform 12 adjacent to the marker 14. The measuring indicia on the scale 68 include the gradation markings 70 and 72 in metric and English units respectively. The indicia also include a pair of triangular-shaped pointers 74 and 76 slideably mounted on the scale 68. The pointers 74 and 76 are adjustably moveable in a transverse direction relative to the first marker 14. The pointers 74 and 76 can be set at a selected transverse distance from the marker 14 corresponding to the desired spacing of buttons and buttonholes of a garment to be manufactured.

The machine 10 greatly simplifies the marking of locations of interengageable, mating male and female fastener positions on clothing. To carry out this task an operator brings together in juxtaposition the edges of clothing material which are to bear the corresponding male and female portions of fasteners, such as buttons and buttonholes. For example, the edges of the front of a shirt or blouse are juxtaposed together in the alignment which they are to assume in the finished garment. This is most easily accomplished by aligning the hem edges of the garment at one end and manually pinching the material together at the opposite end near the collar of the garment. The fabric edges can be juxtaposed together in the lapped relationship which they are to assume on the garment as worn, but for ease of manufacture the two facing edges are preferably juxtaposed back to back.

The fabric edges are placed atop the platform 12 and are aligned generally parallel to the scale 68. The desired spacing of buttons and buttonholes is selected by means of the pointers 74 and 76. The hem edges of the garment are then positioned adjacent to one of the pointers, such as the pointer 74. The location of the first or lowermost button and buttonhole will thereupon be in vertical alignment with the markers 14 and 24. The pedal 66 of the foot treadle 30 is depressed so that the control line 32 draws the crossbeam 58 vertically downwardly. The crossbeam 58 drives the rod 22 downwardly, thus bringing the second marker 24 into contact with the upper exposed surface of the juxtaposed fabric edges. The juxtaposed fabric edges are thereby pinched from opposite sides by the vertically aligned first and second markers 14 and 24, respectively. The graphite markers 14 and 24 thereupon simultaneously mark the juxtaposed edges of the fabric on the opposite, exposed surfaces thereof.

The pedal 66 of the treadle 30 is thereupon released, and the treadle spring 67 pushes the pedal 66 back up to its released position. This releases the tension on the control line 32 so that the coil spring 24 pushes upwardly on the bearing pin 28 thereby drawing the control rod 22 and the second marker 24 vertically upwardly and away from the edges of the fabric material. By pinching the fabric edges between the graphite markers, marks are left on the exposed surfaces of the juxtaposed fabric edges to accurately locate the exact positions of buttons and buttonholes for the garment.

Once the treadle 30 is released, the operator draws the juxtaposed fabric edges transversely across the platform 12 until the first graphite marks are adjacent to the pointer 74. The treadle is again depressed, thereby marking the juxtaposed edges with the correct positions of the second mating button and buttonhole. The treadle 30 is again released and the juxtaposed fabric edges are again drawn transversely across the platform 12 to bring the second button and buttonhole marks into alignment with the pointer 74. The steps of pinching the fabric edges between the markers 14 and 24 and advancing the fabric edges transversely across the platform 12 are repeated until all of the fastener locations have been marked on the juxtaposed edges of material.

The pointers 74 and 76 can be set at the desired spacing from the marker 14, depending upon the size of the garment and the number of buttons to be sewn along the fabric edges thereof. In any case, the juxtaposed fabric edges are transversely moved across the platform 12 until the most recently marked fastener location reaches an indicator that is transversely spaced a specified distance from the markers.

Undoubtedly, numerous variations and modifications of the invention will become readily apparent to those familiar with the manufacture of clothing. For example, while a method and device for marking the locations of buttons and buttonholes has been described herein, the invention is equally applicable to other types of fasteners which employ mating male and female portions, such as snap fasteners, buckles and the like. Accordingly, the scope of the invention should not be construed as limited to the specific embodiment and implementation described, but rather is defined in the claims appended hereto.

I claim:

1. An apparatus for marking mating male and female fastener locations on garments comprising a flat platform, a first marking means located at said flat platform, a scale mounted on said platform adjacent to said first marking means, pointer means mounted on said scale and adjustably moveable in a transverse direction relative to said first marking means, guide means spaced from said platform in longitudinal alignment with said first marking means, mounting means holding said guide means in spatial separation from said platform, a rod reciprocally mounted in said guide means, second marking means carried by said rod and directed toward said first marking means, biasing means disposed to urge said rod away from said platform, and actuating means for overcoming said biasing means to draw said second marking means toward said first marking means.

2. Apparatus according to claim 1 wherein said first marking means is a graphite pencil located in an opening in said platform and longitudinally positionable therewithin.

3. Apparatus according to claim 1 wherein said actuating means is manually actuable.

4. An apparatus for marking mating male and female fastener locations on garments comprising a flat platform, a first marking means located at said flat platform, guide means spaced from said platform in longitudinal alignment with said first marking means, mounting means holding said guide means in spatial separation from said platform and including a longitudinal track, an elongated stabilizing slide reciprocally mounted to move along said track, a rod reciprocally mounted in said guide means to move parallel to said track and parallel to said stabilizing slide, a connecting cross beam hingedly joined to both said rod and said stabilizing slide, second marking means carried by said rod and directed toward said first marking means, biasing means disposed to urge said rod away from said platform, and actuating means for overcoming said biasing means to draw said second marking means toward said first marking means.

5. Apparatus according to claim 4 wherein said actuating means includes a manually actuable foot treadle and a line extending between said foot treadle and said crossbeam.

6. In a method of manufacturing clothing having releasable fasteners with mating male and female portions using longitudinally aligned first and second markers which are spring biased apart, a scale extending transversely relative to said first marker, and pointer means adjustably positionable along said scale, the improvement comprising establishing a mating fastener interval by moving said pointer means transversely along said scale to a location a predetermined distance from said first marker, juxtaposing two edges of material which are to respectively bear said male and female fastener portions, drawing said longitudinally aligned first and second markers into contact with the exposed surfaces of said juxtaposed edges from opposite sides thereof to simultaneously mark both edges with markings, drawing said markers apart, transversely advancing said justaposed edges of material to move said markings transversely said predetermined distance to said pointer means, and repeating said steps of drawing said markers into contact with said juxtaposed edges, drawing said markers apart, advancing said juxtaposed edges, until said juxtaposed edges have been marked by receiving sequential markings thereon corresponding to all mating fasteners to be located thereon.

7. A method of marking the locations of interengageable, mating male and female fasteners on portions of clothing using longitudinally aligned first and second markers which are spring biased apart, a scale extending transversely relative to said first marker, and pointer means adjustably positionable along said scale, comprising: establishing a mating fastener interval by moving said pointer means along said scale to a location a predetermined distance from said first marker, juxtaposing the edges of clothing material which are to bear the corresponding male and female portions of said fasteners, pinching said juxtaposed edges from opposite sides with said longitudinally aligned first and second markers to simultaneously mark said juxtaposed edges on the opposite, exposed surfaces thereof, releasing said juxtaposed edges, transversely advancing said juxtaposed edges said predetermined distance to said pointer means, and repeating said steps of pinching, releasing and advancing until all fastener locations on said juxtaposed edges of material have been marked.

* * * * *